US007316392B2

(12) United States Patent
Honegger

(10) Patent No.: US 7,316,392 B2
(45) Date of Patent: Jan. 8, 2008

(54) METHOD OF CONVEYING FLAT, FLEXIBLE PRODUCTS AND APPARATUS FOR IMPLEMENTING THE METHOD

(75) Inventor: Werner Honegger, Bach (CH)

(73) Assignee: Ferag AG, Hinwil (CH)

( * ) Notice: Subject to any disclaimer, the term of this patent is extended or adjusted under 35 U.S.C. 154(b) by 110 days.

(21) Appl. No.: 10/436,573

(22) Filed: May 13, 2003

(65) Prior Publication Data

US 2003/0218297 A1 Nov. 27, 2003

(30) Foreign Application Priority Data

May 22, 2002 (CH) ..... 0848/02

(51) Int. Cl.
*B65H 29/04* (2006.01)

(52) U.S. Cl. ..... 271/204; 294/104

(58) Field of Classification Search ..... 271/69, 271/199, 204, 205; 198/470.1, 478.1, 476.1; 294/104, 99.1; 101/232
See application file for complete search history.

(56) References Cited

U.S. PATENT DOCUMENTS

| | | | | |
|---|---|---|---|---|
| 4,582,272 A | | 4/1986 | Reist | 242/59 |
| 5,350,167 A | * | 9/1994 | Hansch | 271/82 |
| 5,645,679 A | * | 7/1997 | Hansch | 156/566 |
| 5,755,436 A | | 5/1998 | Reist | 271/204 |
| 5,931,459 A | * | 8/1999 | Landgren | 271/204 |
| 5,957,449 A | * | 9/1999 | Luthi | 271/204 |
| 6,976,675 B2 | | 12/2005 | Gosslinghoff | |
| 2002/0038752 A1 | | 4/2002 | Mader | |

FOREIGN PATENT DOCUMENTS

| | | | |
|---|---|---|---|
| FR | 2 422 575 | | 11/1979 |
| JP | 5-97303 | * | 4/1993 |

* cited by examiner

*Primary Examiner*—Patrick Mackey
*Assistant Examiner*—Thomas Morrison
(74) *Attorney, Agent, or Firm*—Brinks Hofer Gilson & Lione

(57) ABSTRACT

The invention relates to a method of conveying flat, flexible products, in particular printed products, and to an apparatus for implementing the method. According to the invention, the products are conveyed by means of a conveying device which comprises grippers which are moved along a movement path, grip at least one product in the region of one edge, can be controlled individually to open and close and have at least two gripper jaws, to a transfer region. There, they are deposited, at least partly overlapping one another, on a conveyor belt which is arranged substantially horizontally, runs in the conveying direction and belongs to a belt conveyor, and are conveyed away by the latter. In the transfer region, the movement path is curved and approaches the conveyor belt in the vertical direction. The products are conveyed by the conveying device in a hanging position and, in the transfer region before being deposited on the conveyor belt, are moved in such a way that the non-gripped edge of the product moves at the same path speed or a lower path speed than the gripped edge. The result, with careful handling of the products, is the implementation of an apparatus having a conveying device which requires little space.

6 Claims, 2 Drawing Sheets

METHOD OF CONVEYING FLAT, FLEXIBLE PRODUCTS AND APPARATUS FOR IMPLEMENTING THE METHOD

FIELD OF THE INVENTION

The invention relates to a method of conveying flat, flexible products, in particular printed products, and also to an apparatus for implementing the method.

BACKGROUND OF THE INVENTION

A method and an apparatus of the type cited at the beginning are disclosed by published U.S. Patent Application No. 20020038752. In this case, products are picked up from the preceding process by a gripper conveyor and moved along a circular endless movement path. Underneath the gripper conveyor there is a belt conveyor, on which the products are deposited at least partly overlapping one another, that is to say in an overlapping formation. For this purpose, the grippers of the gripper conveyor are constructed in such a way that they can be driven individually to open and close, in order to release the products at a predefined location for transfer to the belt conveyor. Since the orientation of the grippers and therefore of the gripped product relative, to the movement path is not changed before the transfer, and the gripper moves along a sharply curved movement path, the non-gripped edge of the product moves at a considerably higher path speed than the gripped edge or the gripper itself. Furthermore, the product has a relatively high speed component in the vertical direction, that is to say in the direction of the conveyor belt. Therefore, when being deposited on the conveyor belt, the non-gripped edge is subjected to correspondingly high braking forces. As a result, the controlled deposition of a product and its careful handling are made more difficult.

In order to reduce this problem somewhat, it is known to design the actual transfer region so that it is not curved, instead to transfer the products in a transfer region running parallel to the belt conveyor. In this case, the conveying device is configured in such a way that the grippers in the transfer region are moved along a movement path running parallel to the belt conveyor. The gripper only opens in this rectilinear portion in order to deposit a product. The quality of the overlapping stream can be improved in this way. However, it is disadvantageous that the conveying device must have a certain minimum extent in the conveying direction of the belt conveyor and therefore cannot be implemented in a space-saving manner.

SUMMARY OF THE INVENTION

The invention is therefore based on the object of providing a method and an apparatus for conveying flat, flexible products in which the aforementioned disadvantages are avoided and the products can be deposited on the conveyor belt of a belt conveyor in a careful manner with a small requirement for space.

According to the invention, in a method and an apparatus of the type mentioned at the beginning, the movement path of the grippers is curved in the transfer region and approaches the conveyor belt in the vertical direction. In principle, a transfer region with a low requirement for space in the conveying direction of the belt conveyor can be implemented by means of the curvature.

With respect to the belt conveyor, the movement path can approach its conveyor belt from above or from below. In the latter case, the movement path crosses the plane of the belt conveyor coming from below and, for example, is led in a curve around the start of the belt conveyor. The product is ultimately likewise deposited on the belt from above. The area enclosed by the movement path and facing away from the belt conveyor is convex in the case of the approach from above or concave in the case of the approach from below.

According to the invention, the products are conveyed by the conveying device in a hanging position. Hanging position is understood to mean that the products are aligned substantially vertically, but they can also be curved slightly owing to the force of gravity.

According to the invention, the products conveyed in a hanging position are moved, in the transfer region before being deposited on the conveyor belt, in such a way that the non-gripped edge of the product is moved at the same or a lower path speed than the gripped edge or the gripper itself. The corresponding movement, in particular in the case of approaching the plane of the belt conveyor from below, can be implemented merely by means of a suitable shape of the movement path. In this case, the alignment of the grippers relative to the movement path is not necessarily variable. On the other hand, it is preferred for the grippers to approach the conveyor belt from above. In this case, the gripper mouths initially assume an orientation in their direction of circulation in order then to pivot over in the transfer region into an orientation counter to the conveying direction of the belt conveyor. The corresponding movement of the grippers is brought about by using suitable slotted guide control. The result of this is that the non-gripped edge of the products, which was initially moved in the hanging state at approximately the same path speed as the gripped edge, is moved at a lower path speed than the opposite gripped edge in the curved transfer region. In this region, the non-gripped end preferably remains largely stationary, while the change in direction of the product is effected by the shape of the movement path and the orientation of the grippers.

The grippers are preferably aligned at every instant in such a way that the product remains largely flat or is only slightly curved. In this case, the grippers are preferably moved in such a way that the gripper jaw facing the belt conveyor is aligned substantially parallel to the plane of the deposited products as the product is deposited.

BRIEF DESCRIPTION OF THE DRAWINGS

Examples of the invention are illustrated in the drawings and described in the following text. In the drawing, purely schematically.

DESCRIPTION OF THE PREFERRED EMBODIMENT

Figure 1:
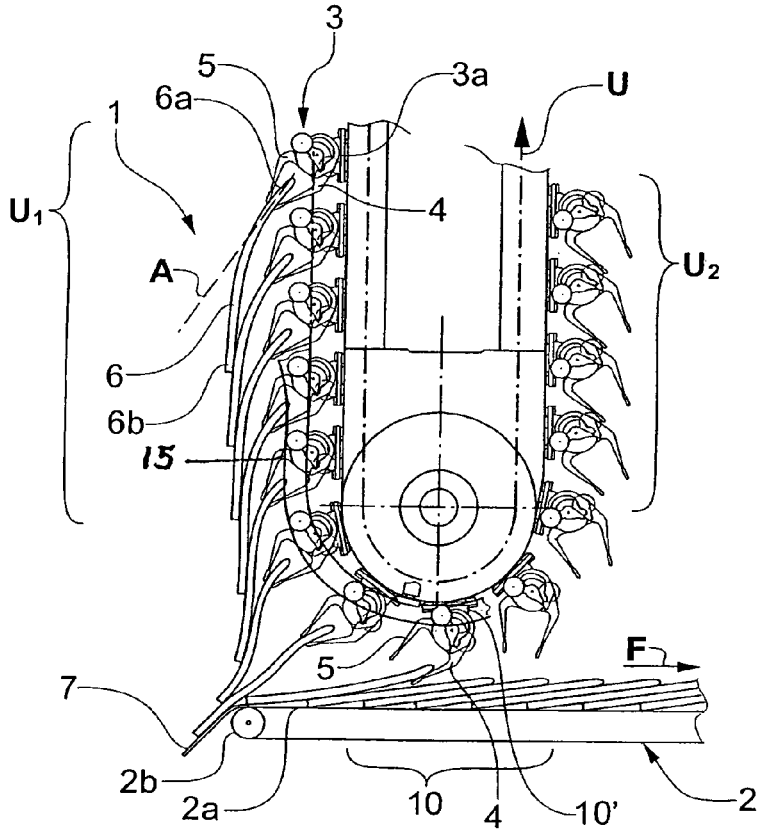
FIG. 1 shows an apparatus according to the invention during the conveyance and deposition of one product in each case.
Figure 2:
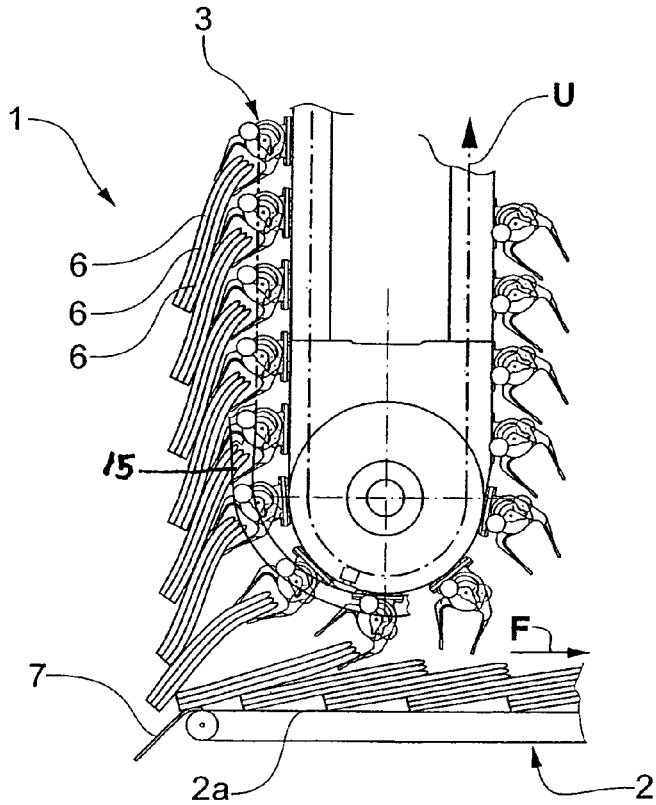
FIG. 2 shows the apparatus from FIG. 1 during the conveyance and deposition of three products in each case.
Figure 3A:
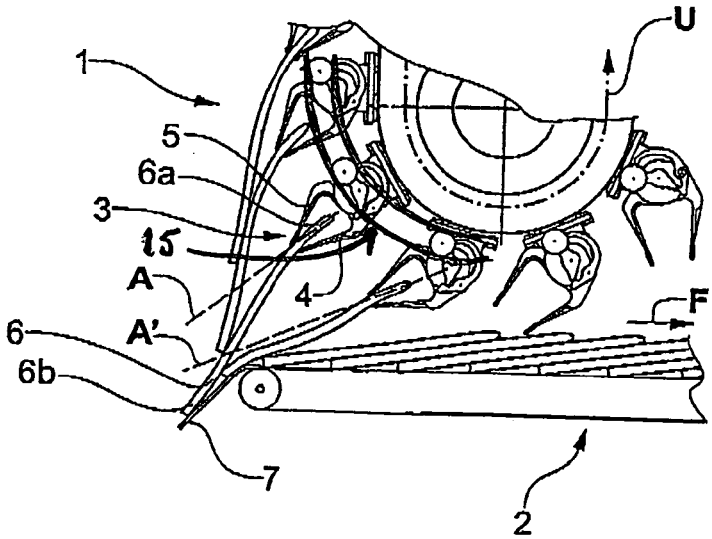
FIGS. 3*a-c* show a detailed view of the apparatus according to FIG. 1 in various snapshots during the deposition of a product.
Figure 3B:
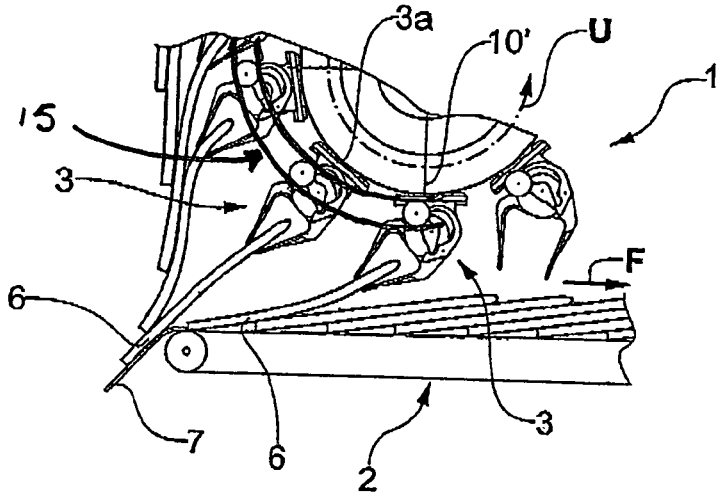
Figure 3C:
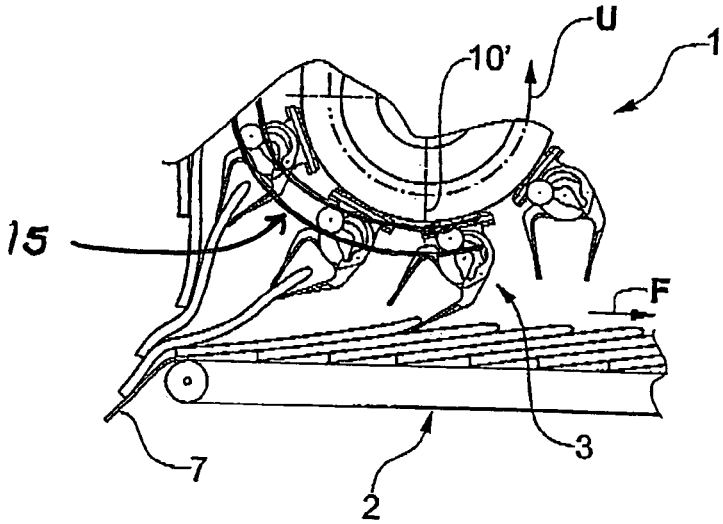

FIG. 1 shows an apparatus according to the invention, having a conveying device 1 constructed as a gripper conveyor and a belt conveyor 2 for conveying the products 6 deposited in an overlapping formation away in the conveying direction F. FIG. 2 shows the same apparatus, in which the grippers 3 of the conveying device 1 in each case hold three products 6 lying congruently one above another and transfer them simultaneously to the belt conveyor 2. In this case, an overlapping formation comprising mini-layers of three products in each case is produced. A detail of the transfer region 10 from FIG. 1 in various snapshots is shown by FIGS. 3*a-c*.

The conveying device 1 comprises a plurality of grippers 3 moved along a movement path U. The grippers 3 have two gripper jaws 4, 5, which can be pivoted relative to each other about a pivot axis running at right angles to the plane of the drawing in order to open and close. The individual opening of the grippers 3 is brought about by a slotted guide control system, not illustrated here. A gripper is in each case opened at the point of closest approach 10' of the movement path U to the belt conveyor 2. The grippers 3 or the two gripper jaws 4, 5 can additionally be pivoted about an axis running at right angles to the plane of the drawing. The orientation of the grippers 3 and, in particular the direction A of the gripper mouth relative to the movement path U and relative to the gripper body 3*a* can therefore be varied individually as a function of the position of the grippers 3 within the movement path U. Examples of suitable grippers are described in U.S. Pat. No. 5,395,151. The pivoting movement relative to the movement path and to the gripper body 3*a*, which is shown in each of FIGS. 1, 2 and 3(*a-c*), is also implemented by means of a slotted guide control system not illustrated here.

In the present case, the movement path U comprises two portions U1, U2 which run vertically and between which there is the curved transfer region 10. In the present case, approximately the semicircular region of the movement path U can be designated the transfer region 10. In the first portion U1 of the movement path U, lying upstream of the transfer region, the grippers 3 are oriented in such a way that their gripper mouth, bounded by the two gripper jaws 4, 5, points in a direction A which is inclined out of the vertical by about 45°. In the first portion U1, the grippers 3 hold products 6. The latter bend downward owing to the force of gravity, so that over a large part of their length they assume a substantially vertical position. Since the first portion U1 is straight, the non-gripped edges 6*b* of the products 6 move at approximately the same path speed as the gripped edges 6*a*. In the curved transfer region, according to the invention the gripper orientation is changed in such a way that the non-gripped edge 6*b* continues to be conveyed at the same path speed or preferably at a lower path speed than the gripped edge 6*a* of the product. The curvature of the transfer region 10 is therefore compensated for by the change in the orientation of the grippers 3. The conveying device 1 can therefore be designed in a very space-saving manner with a sharp curvature in the transfer region and therefore in the conveying direction. For example, it is curved in such a way that there is space for 3 to 5 grippers in the transfer region 10.

When being deposited from a hanging position, in which the non-gripped edge 6*b* is arranged in front of the gripped edge along the movement path U, the product 6 is brought into a lying position, in which the non gripped edge 6*b* is located behind the gripped edge 6*a* in the direction of movement along the movement path U or in the conveying direction F of the belt conveyor 2. The grippers 3 maintain the orientation assumed in the transfer region 10 relative to the movement path U even after they have opened in the second portion U2 of the movement path U running vertically upward. A change in the alignment needs to be made only before or after a new product has been picked up at a transfer point, not illustrated here.

As FIG. 1 shows, the non-gripped end 6*b* of a product approaches the plane defined by the conveyor belt 2*a* first. It is advantageous if, as illustrated here, the conveyor belt is arranged in such a way that the non gripped end 6*b* can cross the plane of the conveyor belt 2*a*, preferably by the start 2*b* of the belt conveyor 2 being located in the transfer region 10. In the present case, the conveyor belt 2*a* has at its start 2*b* a supporting element 7 in the form of a guide element which is bent obliquely downward, on which the non-gripped end 6*b* comes to lie as it is lowered and from which it is drawn off again as it is conveyed onward. The supporting element 7 has the advantage that the free end 6*b* is imparted a preferred direction. The end 6*b* is prevented from being carried away with the conveyor belt 2*a* before the gripped end 6*a* of the product 6 has been deposited on said conveyor belt 2*a*.

As illustrated, the grippers 3 are moved in space in such a way that the gripped product is largely straight or only slightly curved until deposited. It is therefore also advantageous if the gripper jaw 4 facing the belt conveyor 2 is aligned substantially parallel to the plane of the deposited products 6 as it deposits the product 6.

The grippers 3 of the conveying device 1 from FIG. 2 are moved, as already described. The fact that they in each case grip and transfer three products 6 has no influence on the movement sequence.

In FIGS. 3*a c*, it is possible to see how the grippers 3 change their position from the alignment A to A' in the curved transfer region 10. This achieves careful transfer of the products 6.

The invention claimed is:

1. A method of conveying flat, flexible products, in particular printed products, comprising:

a) gripping one or more products adjacent gripped edges by means of grippers having two gripper jaws forming a gripper mouth;

b) moving the grippers with the gripped products along a movement path toward a transfer region, wherein the movement path in the transfer region is curved and in the curved transfer region approaches a horizontally running conveyor belt from above;

c) before reaching the transfer region, conveying the gripped products from their gripped edges in the gripper mouth with the ungripped edges in a substantially hanging position and the gripper mouth inclined out of the vertical at a predetermined angle to the vertical;

d) upon reaching the transfer region of the movement path, changing the orientation of the grippers such that the gripper mouths change their position from being inclined out of the vertical at said predetermined angle to being inclined at a greater angle to the vertical than said predetermined angle and the products are moved in a way that the ungripped edge of the product lying opposite the gripped edge is moved at the same path speed or a lower path speed than the gripped edge;

e) depositing the products, at least partly overlapping one another, on the conveyor belt; and f) conveying away the deposited products by means of the conveyor belt.

2. The method as claimed in claim 1, comprising orienting the grippers relative to the movement path in the transfer region in such a way that the gripped product is moved from a first position, in which the gripped edge is arranged behind the ungripped edge in the direction of movement, into a second position, in which the gripped edge is arranged in front of the ungripped edge in the direction of movement.

3. The method as claimed in claim 2 comprising moving and orienting the grippers in such a way that the gripped edge of a product comes to lie on a supporting element arranged at the start of the transfer region and rests there during at least part of the movement of the grippers along the movement path in the transfer region, or is shifted only slightly.

4. The method as claimed in claims 1, 2 or 3, wherein in the transfer region the orientation of grippers are changed in such a way that the gripper jaw facing the conveyor belt is aligned substantially parallel to the plane of the deposited products as the product is deposited.

5. The method as claimed in claims 1, 2 or 3 comprising moving the grippers in a first portion of the movement path arranged upstream of the transfer region, and in a second portion of the movement path arranged downstream of the transfer region substantially at right angles to the conveyor belt.

6. The method as claimed in claim 4, comprising moving the grippers of the movement path in a first portion arranged upstream of the transfer region, and in a second portion of the movement path arranged downstream of the transfer region substantially at right angles to the conveyor belt.

* * * * *